US008212226B2

(12) United States Patent
Chisholm

(10) Patent No.: US 8,212,226 B2
(45) Date of Patent: Jul. 3, 2012

(54) PLASTIC CONTAINER AND METHOD OF MANUFACTURE HAVING MOLDED-IN-SECURITY FEATURES

(75) Inventor: Brian John Chisholm, Sylvania, OH (US)

(73) Assignee: Rexam Healthcare Packaging Inc., Perrysburg, OH (US)

( * ) Notice: Subject to any disclaimer, the term of this patent is extended or adjusted under 35 U.S.C. 154(b) by 1147 days.

(21) Appl. No.: 12/075,642

(22) Filed: Mar. 13, 2008

(65) Prior Publication Data

US 2010/0321160 A9 Dec. 23, 2010

(51) Int. Cl.
*B65D 23/14* (2006.01)

(52) U.S. Cl. ..... 250/461.1

(58) Field of Classification Search ..... 250/461.1, 250/459.1; 40/543, 542; 283/92
See application file for complete search history.

(56) References Cited

U.S. PATENT DOCUMENTS

| | | | | |
|---|---|---|---|---|
| 2,577,030 | A * | 12/1951 | Neumann | 250/487.1 |
| 2,929,931 | A * | 3/1960 | Richter et al. | 250/461.1 |
| 4,567,370 | A * | 1/1986 | Falls | 250/461.1 |
| 5,581,978 | A | 12/1996 | Hekal et al. | |
| 6,226,619 | B1 | 5/2001 | Halperin et al. | |
| 6,234,536 | B1 * | 5/2001 | Pittman et al. | 283/81 |
| 6,297,508 | B1 | 10/2001 | Barmore et al. | |
| 7,109,415 | B2 * | 9/2006 | Neitzel et al. | 174/50 |
| 2004/0064989 | A1 * | 4/2004 | Nottage et al. | 40/542 |
| 2005/0116465 | A1 | 6/2005 | Muscat | |
| 2005/0145525 | A1 | 7/2005 | Williams | |
| 2005/0170113 | A1 | 8/2005 | Hill | |
| 2005/0191451 | A1 | 9/2005 | Osika et al. | |
| 2006/0042969 | A1 | 3/2006 | Swan et al. | |
| 2006/0061475 | A1 | 3/2006 | Moskowitz et al. | |
| 2007/0024445 | A1 | 2/2007 | Weslake et al. | |
| 2007/0024975 | A1 | 2/2007 | McGrew | |

FOREIGN PATENT DOCUMENTS

| | | | |
|---|---|---|---|
| WO | WO 2008/057150 | A1 | 5/2008 |

* cited by examiner

*Primary Examiner* — Constantine Hannaher
(74) *Attorney, Agent, or Firm* — Reising Ethington PC

(57) ABSTRACT

A molded plastic container, in accordance with one aspect of the present disclosure, includes an insert molded into an exterior surface of a wall of the container. The insert is of plastic construction that includes a UV brightener that is visible under UV light to verify authenticity of the container. The container wall and the insert preferably have identical colors under visible light. The insert preferably is of two-piece construction with an outer portion of the insert being exposed at the exterior surface of the container and an inner portion underlying the outer portion. The inner and outer portions preferably include respective UV brighteners that are visible as different colors under UV light. The outer portion of the insert preferably is removable to expose the inner portion and thereby to provide layered security for which the outer portion is first visible under UV light and, when removed, exposes the inner portion of the insert for illumination under UV light and radiating a different color from the outer portion.

15 Claims, 2 Drawing Sheets

PLASTIC CONTAINER AND METHOD OF MANUFACTURE HAVING MOLDED-IN-SECURITY FEATURES

The present disclosure relates to a molded plastic container having one or more security features molded into a wall of the container, to a method of making such a container, and to a security insert for molding into a wall of a container.

BACKGROUND AND SUMMARY OF THE DISCLOSURE

A general object of the present disclosure is to provide a molded plastic container having a security feature, preferably a layered security feature, molded into a wall of the container, to provide a method of making such a container, and to provide a security feature insert suitable for molding into a wall of a container.

The present disclosure embodies a number of aspects that can be implemented separately from or in combination with each other.

A molded plastic container, in accordance with one aspect of the present disclosure, includes an insert molded into an exterior surface of a wall of the container. The insert is of plastic construction that includes a UV brightener that is visible under UV light to verify authenticity of the container. The container wall and the insert preferably have identical colors under visible light. The insert preferably is of two-piece construction with an outer portion of the insert being exposed at the exterior surface of the container and an inner portion underlying the outer portion. The inner and outer portions preferably include respective UV brighteners that are visible as different colors under UV light. The outer portion of the insert preferably is removable to expose the inner portion and thereby to provide layered security for which the outer portion is first visible under UV light and, when removed, exposes the inner portion of the insert for illumination under UV light and radiating a different color from the outer portion.

A method of verifying authenticity of a molded plastic container, in accordance with another aspect of the present disclosure, includes providing an insert of plastic construction that includes a UV brightener such that the insert has a first color under visible light and a second color under UV light. The insert is molded into an exterior surface of a plastic container wall. The container wall is then exposed to UV light to energize the UV brightener and thereby verify authenticity of the container. The container wall and the insert preferably have the same first color under visible light. The insert most preferably is of two-piece construction, having an inner portion and an outer portion overlying the inner portion. The outer portion is exposed at the exterior surface of the container and is removable from the inner portion. The inner and outer portions have UV brighteners that are visible as different colors under UV light. The outer portion of the insert is exposed to UV light and the resulting color of the outer portion is noted. The outer portion then is removed, and the inner portion is exposed to UV light and the resulting color is noted, providing two layers of security for verifying authenticity of the container.

A molded plastic container, in accordance with a further aspect of the present disclosure, includes an insert molded into an exterior surface of a wall of the container. The insert is of two-piece molded plastic construction, with an outer portion of the insert being exposed at the exterior surface of the container and an inner portion of the insert underlying the outer portion. The outer portion is removable to expose the inner portion. The inner and outer portions of the insert have different security features embedded in or on surfaces of the portions such that the security feature embedded in or on the outer portion is observable and, when the outer portion is removed, the security feature embedded in or on the inner portion becomes observable. This aspect of the disclosure provides layered security with an overt portion associated with the outer portion of the insert and a covert portion associated with the inner portion of the insert. The security features preferably are selected from the group consisting of UV brighteners, microtaggents, chemical tracers, fluorescent agents, and combinations thereof.

BRIEF DESCRIPTION OF THE DRAWINGS

The disclosure, together with additional objects, features, advantages and aspects thereof, will best be understood from the following description, the appended claims and the accompanying drawings, in which:

DETAILED DESCRIPTION OF PREFERRED EMBODIMENTS

Figure 1:
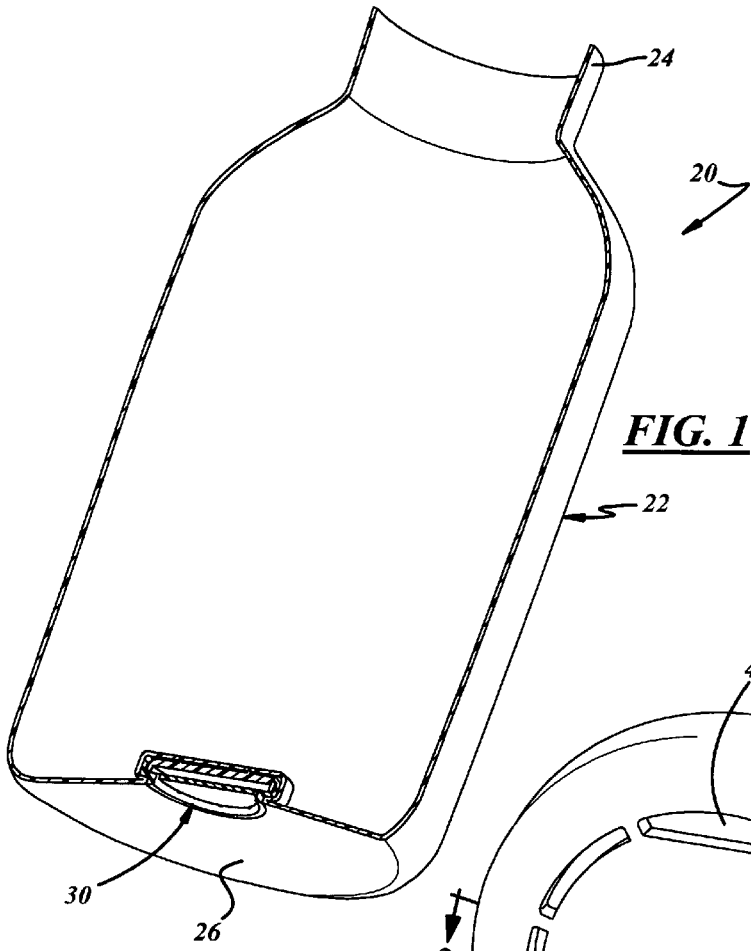
FIG. 1 is a perspective sectional view of a plastic container in accordance with an exemplary embodiment of the present disclosure.
Figure 2:
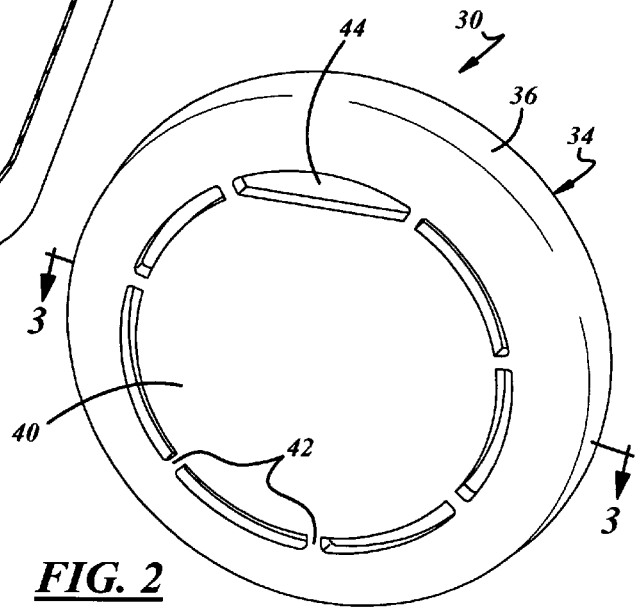
FIG. 2 is a perspective view of the insert molded into the container of FIG. 1.
Figure 3:
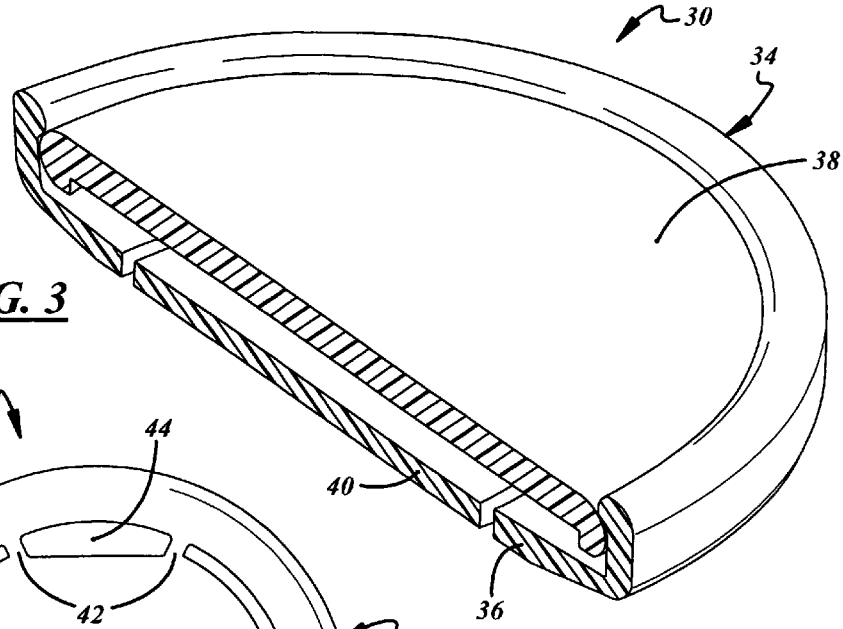
FIG. 3 is a perspective sectional view of the insert in FIG. 2, being taken substantially along the line 3-3 in FIG. 2.
Figure 4:
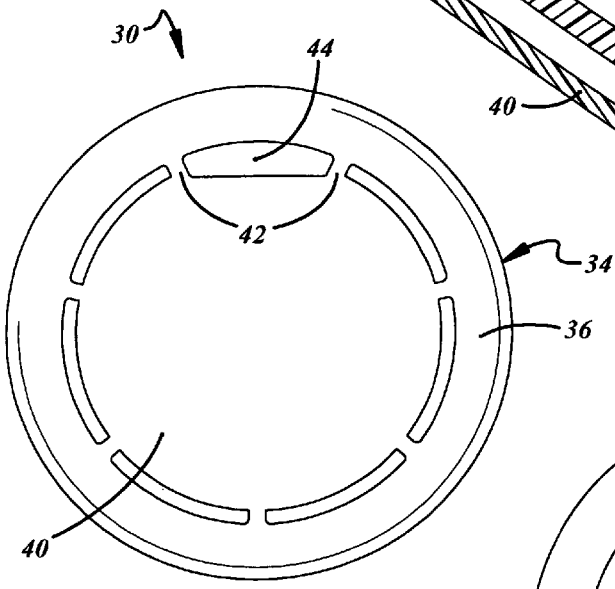
FIG. 4 is an elevational view of the insert in FIGS. 2 and 3 with removable portion intact.

FIG. 1 illustrates a container 20 in accordance with an exemplary embodiment of the present disclosure. Container 20 includes a container body 22 having an open end 24 and a container base or bottom wall 26. Bottom wall 26 typically, although not necessarily, is at the opposite end of container body 22 from open end 24, and typically although not necessarily is at the end of the container body on which the container body normally rests. Container bottom wall 26 can be flat, concave or of any other suitable geometry. The geometry of container 20 illustrated in FIG. 1 is by way of example only. An insert 30 is molded into an exterior surface of a wall of container 20, preferably container bottom wall 26. Insert 34 can be molded into container body 22 in the manner disclosed in U.S. application Ser. No. 11/595,059, or in any suitable manner. Container body 22 is of molded plastic construction, preferably blow molded plastic construction. Container body 22 can be of any suitable plastic material.

Figure 5:
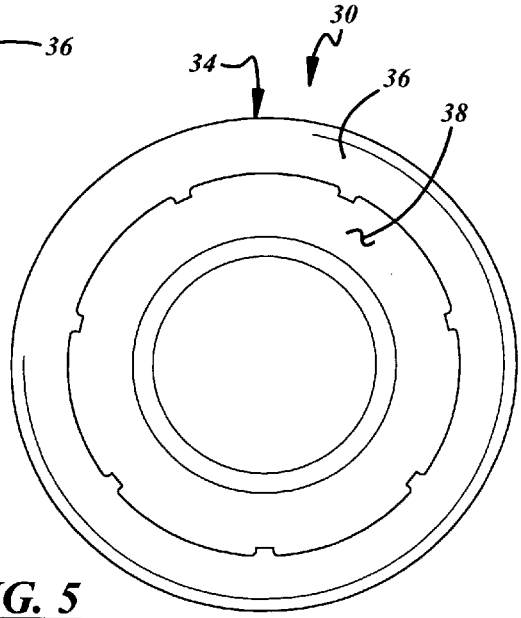
FIG. 5 is an elevational view of the insert in FIG. 4 with removable portion removed.

One exemplary embodiment of insert 30 is illustrated in FIGS. 2-5 as including a plastic housing 34. Plastic housing 34 preferably includes a base 36 and a disk 38 mounted on base 36. Disk mounting can be by any suitable means. Although the exemplary insert embodiment of FIGS. 2-5 has a circular periphery, the periphery of the insert could be non-circular. An RFID inlay can be included within housing 34, as disclosed in U.S. application Ser. No. 11/595,372, although this is not critical to the subject matter of the present disclosure. Either insert base 36 or insert disk 38 preferably is accessible from outside of container 20 after molding. In the exemplary embodiment of FIGS. 1-5, base 36 is accessible from outside of the container, and includes a portion 40 that is removable from the rest of the housing. In the illustrated embodiment, portion 40 comprises the central portion of insert base 36, which is connected to the periphery of base 36, as made, by a plurality of angularly spaced radially extending frangible bridges 42. Other separable connecting means, such as a frangible web, threads or snap beads, could be employed. Base 36 preferably includes a feature to facilitate removal of portion 40. In the illustrated embodiment, this feature comprises an enlarged peripheral opening 44 that can receive a suitable tool to pry portion 40 away from the remainder of base 36 and initiate rupture of frangible bridges 42. In the embodiments disclosed in above-noted application Ser. No. 11/595,372, the removal feature comprises a slot in portion 40 to receive a tool for applying torque to portion 40 and rupturing bridges 42. In any event, with portion 40 removed from base 36, disk 38 is exposed through the opening in the base, as shown in FIG. 5.

Base 36 and disk 38 of housing 34 preferably are of respective plastic constructions and preferably have identical coloring under visible light. Base 36 and disk 38 of housing 34 most preferably have the same coloring as container body 22 under visible light. However, base 36 and disk 38 preferably contain non-identical UV brighteners, which is to say that base 36 and disk 38 have different color appearances under UV light. The UV brighteners preferably are blended with the resins of base 36 and disk 38 prior to molding the base and disk. However, it is within the scope of the present disclosure to apply the UV brighteners to the base and/or the disk after molding. After molding container 20, and typically after the container is filled with product and shipped to a customer site, container 20 can be inverted and exposed to UV radiation (e.g., by a pharmacist), whereupon the outer portion of the insert, in this case the central portion of base 36, will be exposed to UV light and the UV brighteners in base 36 will be energized and emit a color associated with the UV brightener in the base. Base central portion 40 can then be removed and the container bottom wall again exposed to UV radiation, whereupon disk 38 will be exposed to UV light and the UV brighteners in the disk will be energized to emit the color associated with the brightener in disk 38, which has been exposed by removal of base portion 40. This provides two layers or levels of security in the preferred implementation of the disclosure. However, a single layer of security would be provided by the insert as molded, or by a one-piece insert molded into an exterior surface of the container, in accordance with a basic less preferred implementation of the disclosure.

Insert base 36 and insert disk 38 can be of any suitable plastic material such as high density polyethylene (HDPE). Suitable UV brighteners are marketed as optical brightener additives by Ampacet Corp.

There thus have been disclosed a molded plastic container, a method of making a molded plastic container, a method of verifying authenticity of a molded plastic container and an insert for molding into a wall of a container that fully satisfy all of the objects and aims previously set forth. The disclosure has been presented in conjunction with an exemplary embodiment, and additional modifications and variations have been discussed. Other modifications and variations readily will suggest themselves to persons of ordinary skill in the art in view of the foregoing description. For example, the security features associated with the inner and outer portions of the insert are not limited to UV brighteners in accordance with the broadest aspects of the present disclosure. Indeed, other security features, or combinations of security features, could be embedded in or on the inner and outer portions of the insert, such as microtaggents, chemical tracers, fluorescent agents, or combinations of such security features. Suitable microtaggents are commercially available, for example, from Microtrace, LLC of Minneapolis, Minn. Additional security features can be incorporated into the container, overt and/or covert. The disclosure is intended to embrace all such modifications and variations as fall within the spirit and broad scope of the appended claims.

The invention claimed is:

1. A molded plastic container that includes an insert molded into an exterior surface of a wall of the container, said insert being of plastic construction that includes a UV brightener that is visible under UV light to verify authenticity of said container, wherein said insert is of at least two-piece construction, an outer portion of said insert being exposed at said exterior surface and an inner portion of said insert underlying said outer portion, said inner and outer portions including respective UV brighteners that are visible as different colors under UV light.

2. The container set forth in claim 1 wherein said outer portion of said insert is removable to expose said inner portion.

3. The container set forth in claim 2 wherein said container wall and said insert have identical colors under visible light.

4. The container set forth in claim 1 wherein said container has a bottom wall and said insert is molded into said bottom wall.

5. The container set forth in claim 1 wherein said insert includes a housing wherein said outer portion is a base of said housing and said inner portion is a disk of said housing secured to said base, and said base has a central portion that is removable from the rest of said housing and a peripheral opening to facilitate removal of said central portion.

6. The container set forth in claim 1 wherein said insert is not completely enclosed.

7. A method of verifying authenticity of a molded plastic container that includes the steps of:

(a) providing an insert of plastic construction that includes a UV brightener such that said insert has a first color under visible light and a second color under UV light, (b) molding said insert into an exterior surface of a plastic container wall, and (c) exposing said container wall to UV light to energize said UV brightener and verify authenticity of said container wherein said insert provided in said step (a) is of at least two-piece construction, including an inner portion and an outer portion overlying said inner portion as molded into said container wall, said outer portion being exposed at said exterior surface and being removable from said inner portion, said inner and outer portions including UV brighteners that are visible as different colors under UV light, and wherein said step (c) includes: (c1) exposing said outer portion of said insert to UV light and noting the resulting color of said outer portion, (c2) removing said outer portion, and (c3) exposing said inner portion to UV light and noting the resulting color of said inner portion.

8. The method set forth in claim 7 wherein said container wall has said first color under visible light.

9. The method set forth in claim 7 wherein said step (b) includes molding said insert into a bottom wall of said container.

10. An insert for molding into a wall of a container, which includes a housing having a base and a disk secured to said base, said base and said disk being of plastic constructions and including respective UV brighteners that emit different colors under UV light.

11. The insert set forth in claim 10 wherein said base includes a portion that is removable so that said disk is exposed through said base.

12. The insert set forth in claim 10 wherein said base has a central portion that is removable from the rest of said housing and a peripheral opening to facilitate removal of said central portion.

13. A molded plastic container that includes an insert molded into an exterior surface of a wall of the container, said insert being of two-piece molded plastic construction, with an outer portion of said insert being exposed at said exterior surface and an inner portion of said insert underlying said outer portion, said outer portion being removable to expose said inner portion, said inner and outer portions of said insert having different security features embedded in or on surfaces of said portions such that the security feature embedded in or on said outer portion is observable and, when said outer portion is removed, the security feature embedded in or on said inner portion becomes observable.

14. The container set forth in claim 13 wherein said security features are selected from the group consisting of UV brighteners, microtaggents, chemical tracers, fluorescent agents, and combinations thereof.

15. The container set forth in claim 13 wherein said container has a bottom wall and said insert is molded into said bottom wall.

* * * * *